US009883739B1

(12) United States Patent
Chiles et al.

(10) Patent No.: US 9,883,739 B1
(45) Date of Patent: Feb. 6, 2018

(54) WORK TABLE WITH A ROTATABLE COMPONENT TRAY

(71) Applicants: Shane R. Chiles, Lincoln, NE (US); Brandon L. Crounse, Lincoln, NE (US); Kelly D. Jurgens, Beatrice, NE (US)

(72) Inventors: Shane R. Chiles, Lincoln, NE (US); Brandon L. Crounse, Lincoln, NE (US); Kelly D. Jurgens, Beatrice, NE (US)

( * ) Notice: Subject to any disclaimer, the term of this patent is extended or adjusted under 35 U.S.C. 154(b) by 0 days.

(21) Appl. No.: 15/646,581

(22) Filed: Jul. 11, 2017

(51) Int. Cl.

| | |
|---|---|
| ***A47B 85/00*** | (2006.01) |
| ***A47B 13/16*** | (2006.01) |
| ***A47B 13/02*** | (2006.01) |
| ***A47B 13/08*** | (2006.01) |
| ***A63H 33/08*** | (2006.01) |

(52) U.S. Cl.
CPC ..... *A47B 13/16* (2013.01); *A47B 13/02* (2013.01); *A47B 13/081* (2013.01); *A47B 13/088* (2013.01); *A63H 33/08* (2013.01)

(58) Field of Classification Search
CPC ..... A47B 1/00; A47B 1/056; A47B 13/16
USPC ..... 108/64, 65, 66, 25, 26
See application file for complete search history.

(56) References Cited

U.S. PATENT DOCUMENTS 351,101 A * 10/1886 Fauber ..... A47B 1/056 108/66
462,933 A * 11/1891 Sanderson et al. .... A47B 13/16 108/26
535,212 A * 3/1895 Lattard ..... A47B 13/16 108/25
721,806 A * 3/1903 James ..... A47B 11/00 104/38
732,227 A * 6/1903 Shafer et al. ..... A47B 1/056 108/66
821,955 A * 5/1906 Nash ..... A47B 1/056 108/66
923,309 A * 6/1909 Stone ..... A47B 1/056 108/66
993,226 A * 5/1911 Day ..... A41H 9/02 108/66
1,139,564 A * 5/1915 Oberg et al. ..... A47B 1/056 108/66
1,406,116 A * 2/1922 Viles ..... A47B 1/056 108/66
1,411,741 A * 4/1922 Merdzinski ..... A47B 1/02 108/66
2,092,441 A * 9/1937 Ciprus ..... A47B 1/04 108/161
2,171,084 A * 8/1939 Fasce ..... A47B 11/00 108/147
2,555,547 A * 6/1951 Kelleghan ..... A47B 13/14 108/25
3,638,587 A * 2/1972 Uyeda ..... A47B 13/16 108/152

(Continued)

*Primary Examiner* — Jose V Chen
(74) *Attorney, Agent, or Firm* — Dennis L. Thomte; Thomte Patent Law Office LLC

(57) ABSTRACT

A work table for use in assembling Legos, craft items, etc. The work table includes a horizontally disposed and circular table top. A ring-shaped component tray rotatably extends around the table top. The tray includes spaced-apart compartments which are configured to receive various Lego components or craft items.

1 Claim, 6 Drawing Sheets

(56) References Cited

U.S. PATENT DOCUMENTS 4,060,038 A * 11/1977 Ruvolo ..... A47B 11/00
108/104
5,363,772 A * 11/1994 Adamidis ..... A47B 9/00
108/66

* cited by examiner

WORK TABLE WITH A ROTATABLE COMPONENT TRAY

BACKGROUND OF THE INVENTION

Field of the Invention

This invention relates to a work table to be used in assembling Legos, craft items, etc. More importantly, this invention relates to a work table wherein a ring-shaped component tray is rotatably mounted thereon with the tray including separate compartments configured to contain various Lego components, craft items, etc.

Description of the Related Art

Lego items are frequently assembled on a table with the various Lego bricks, parts, pieces or components being scattered around the top of the table or being in boxes or the like near the table. The same is also true with the assembly of craft items such as bracelets, necklaces, etc.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A work table is described for use in assembling articles containing many different components. A work table includes a horizontally disposed circular table member having an upper surface, a lower surface, and an outer end. A plurality of table legs, having upper and lower ends, are provided with the upper ends of the table legs being secured to the lower surface of the circular table member for supporting the circular table member above a supporting surface. A horizontally disposed circular support, having an upper surface and a lower surface, is positioned on the upper surface of the circular table member so as to extend upwardly therefrom. The circular support has a diameter which is less than the diameter of the circular table member to define a tray support portion on the upper surface of the circular table member outwardly of the circular support. A non-rotatable circular table top is positioned above the circular support with the table top having a diameter approximately the same as the diameter of the circular support. A horizontally disposed and ring-shaped tray is positioned on the tray support portion so as to be selectively rotatable with respect to the circular support. The ring-shaped tray with a plurality of compartments formed therein which are configured to receive the separate components of the article to be assembled.

It is therefore a principal object of the invention to provide an improved work table.

A further object of the invention is to provide a work table for use in assembling articles containing many different components such as components from Legos or craft articles.

A further object of the invention is to provide a work table which includes a ring-shaped tray rotatably mounted thereon with the ring-shaped tray having a plurality of compartments formed therein configured to receive components of the article or articles to be assembled.

A further object of the invention is to provide a work table which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
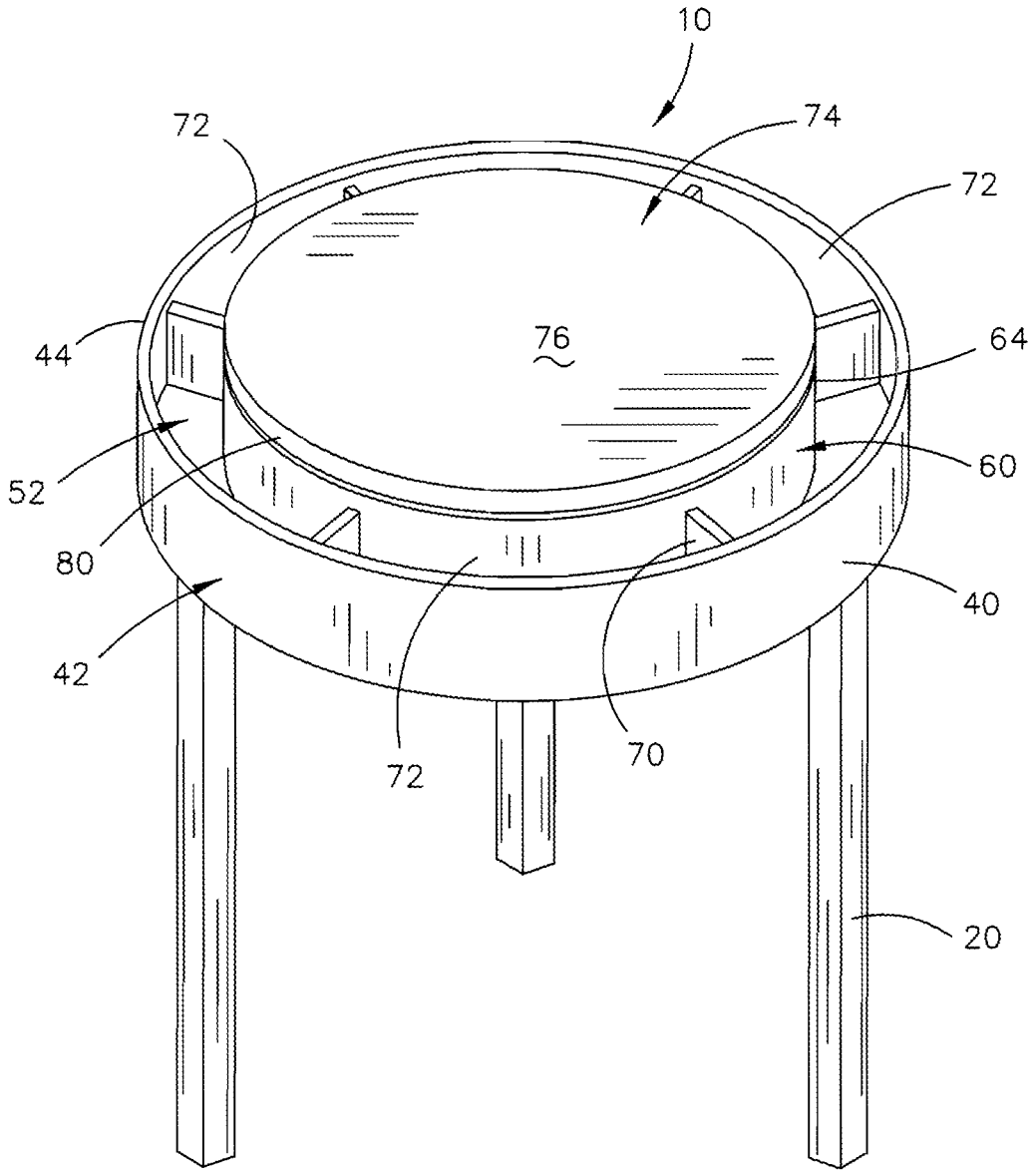
FIG. 1 is a perspective view of the work table of this invention.
Figure 2:
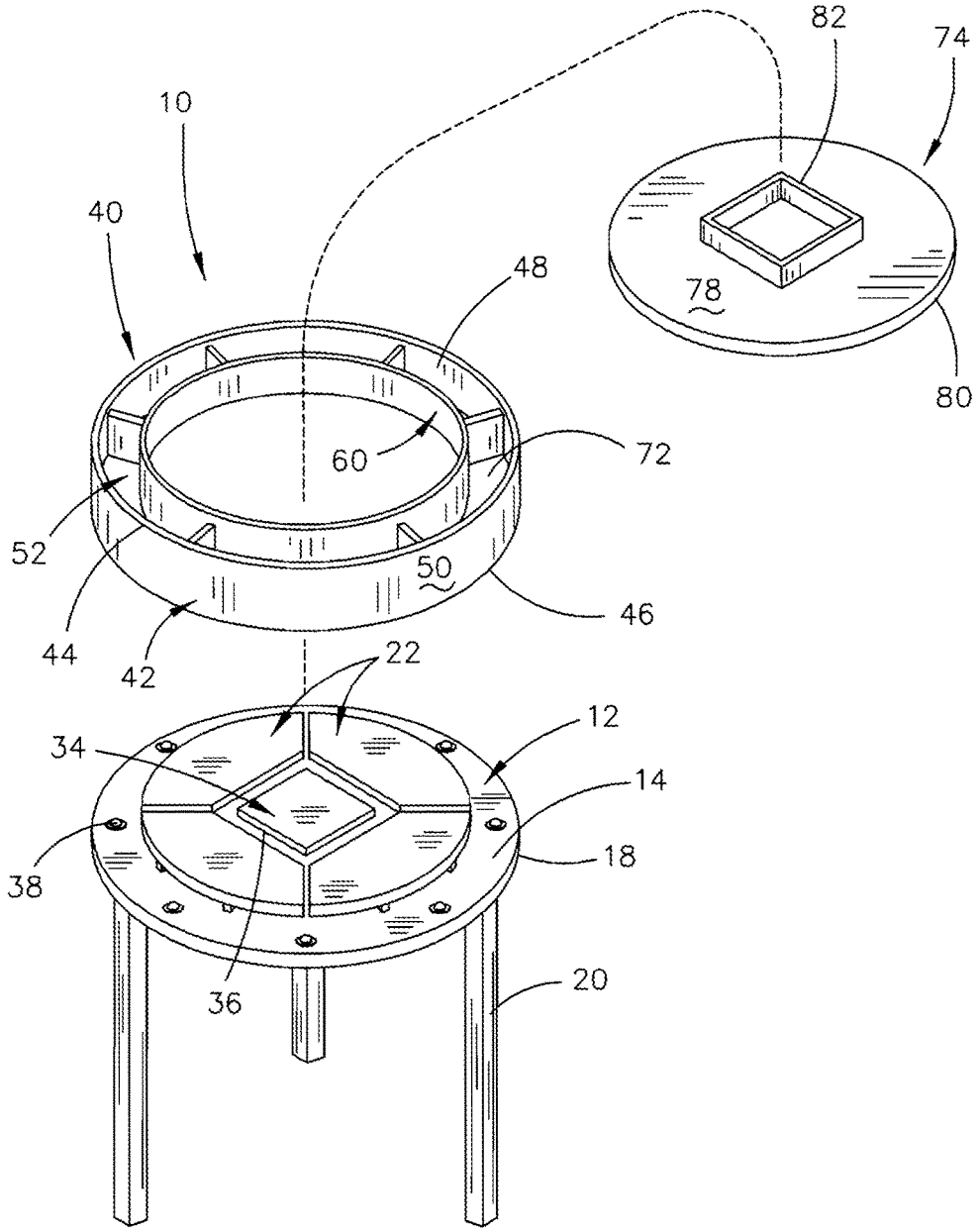
FIG. 2 is a partial exploded perspective view of the work table of this invention.
Figure 3:
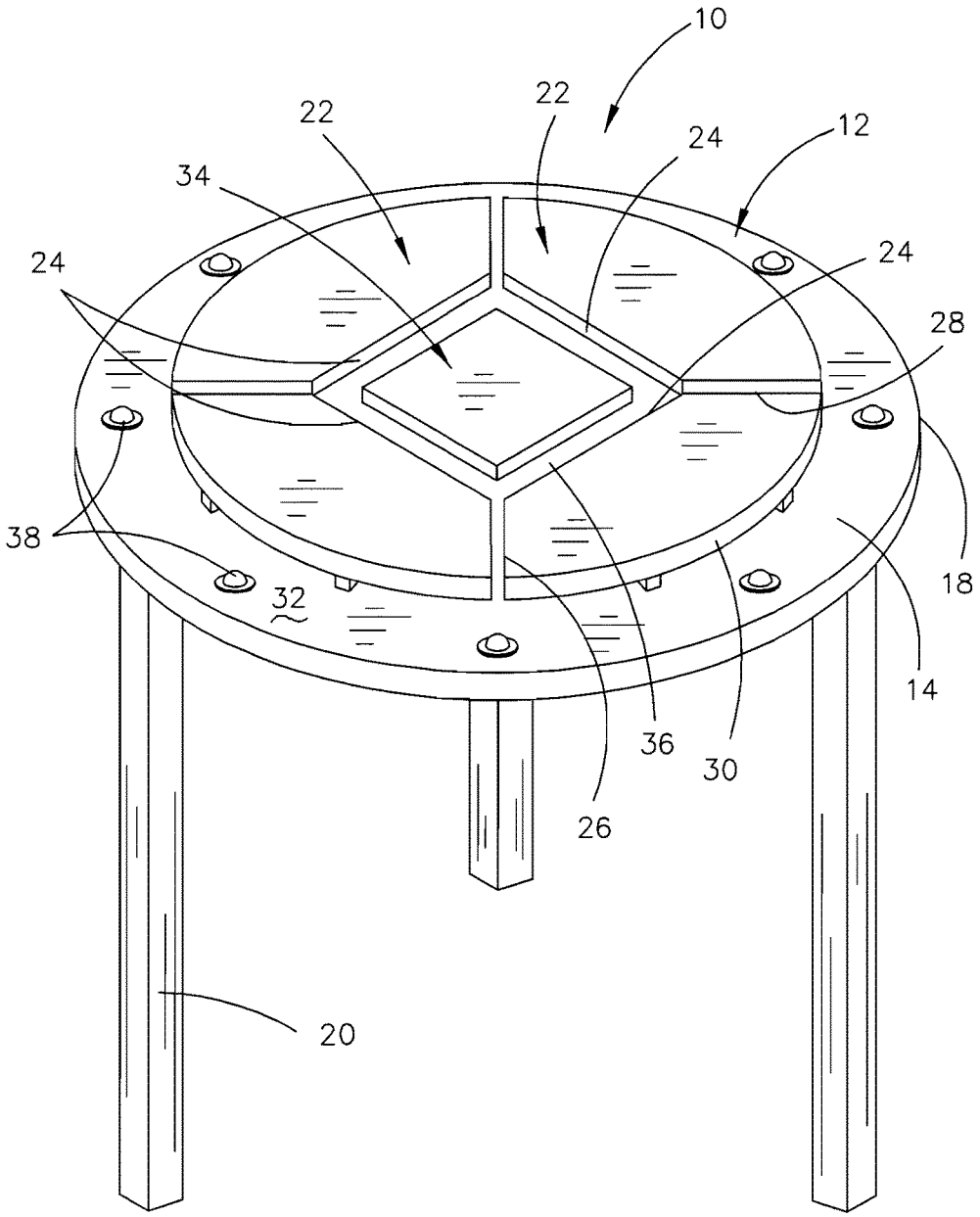
FIG. 3 is a perspective view of a portion of the work table of this invention.
Figure 4A:
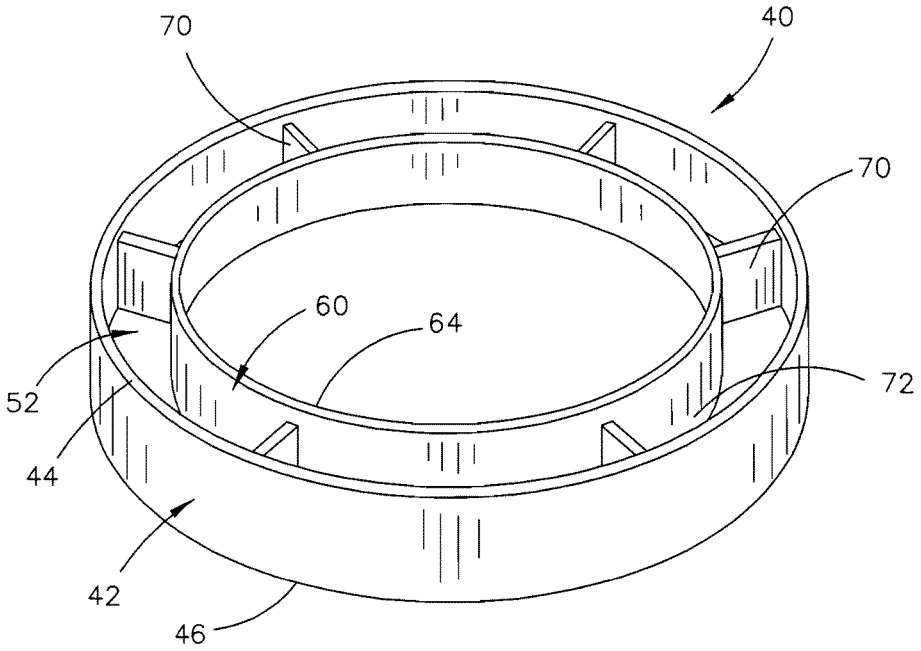
FIG. 4A is a perspective view of the tray of this invention.
Figure 4B:
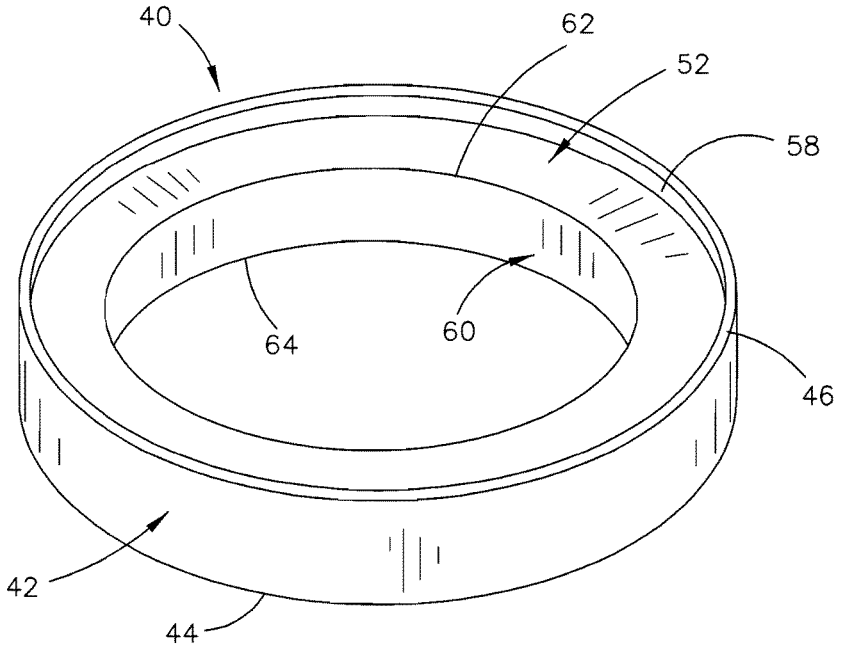
FIG. 4B is a bottom perspective view of the tray of this invention.
Figure 5A:
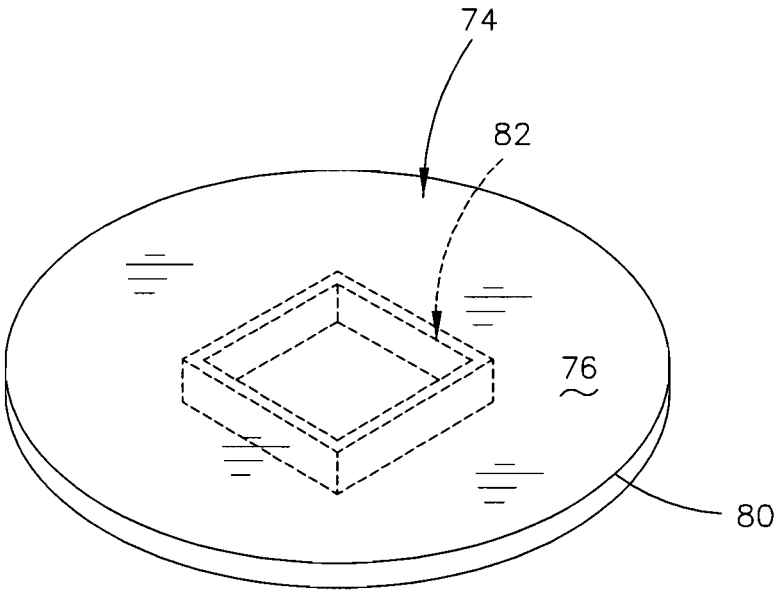
FIG. 5A is an upper perspective and elevational view of the table top of this invention.
Figure 5B:
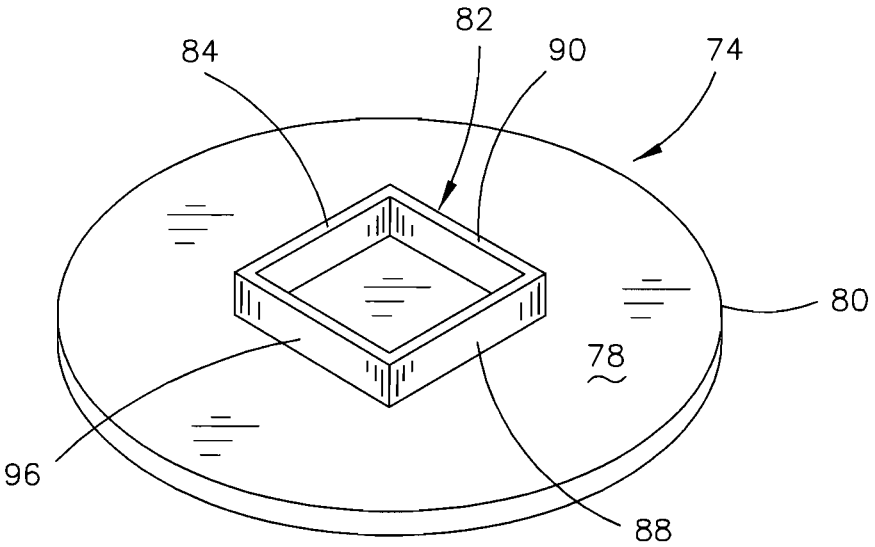
FIG. 5B is a bottom perspective view of the table top of this invention.
Figure 6:
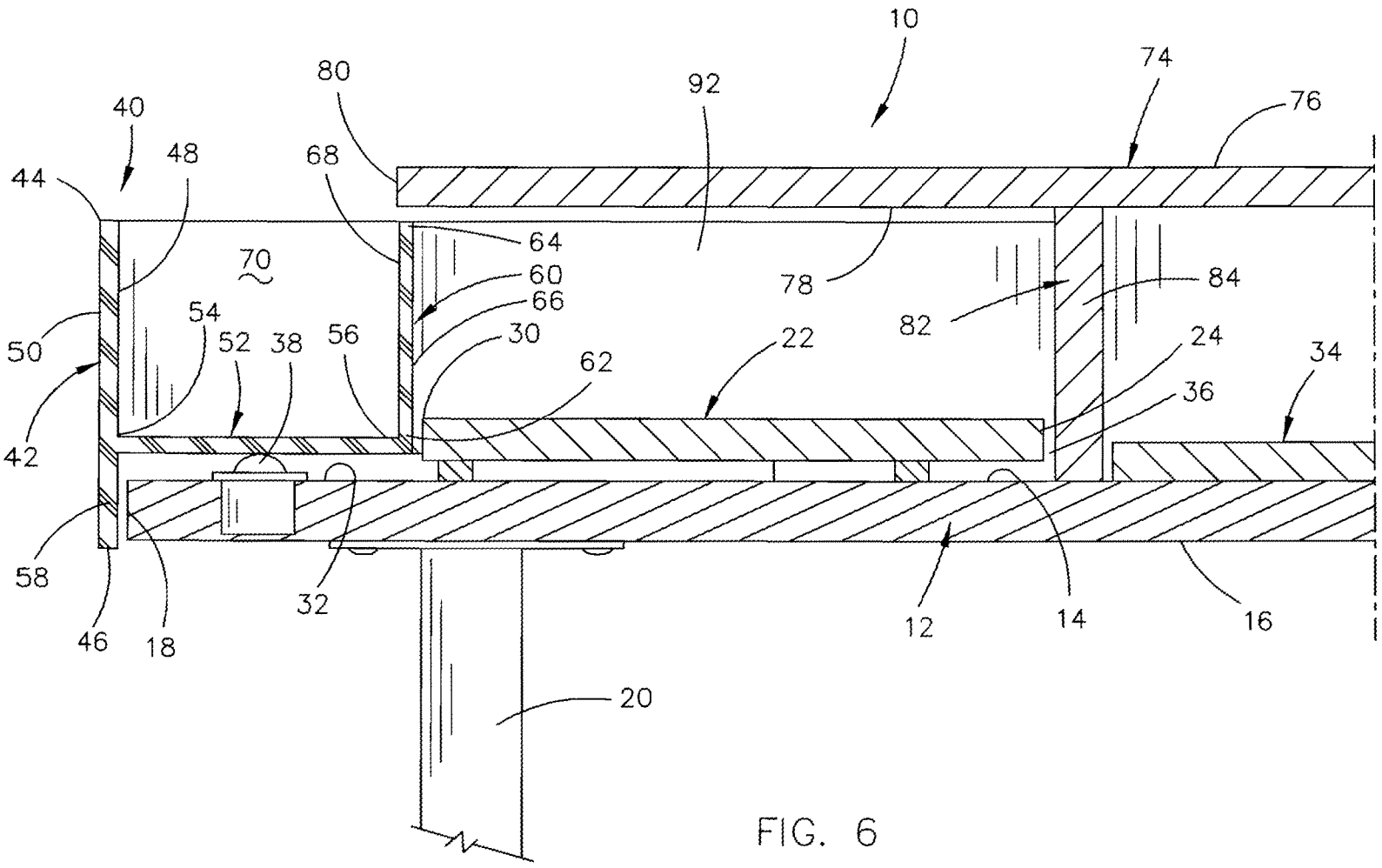
FIG. 6 is a partial sectional view of the table of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The table of this invention is designated by the reference numeral 10. Table 10 includes a horizontally disposed circular table member 12 which is preferably comprised of a wooden material. Table member 12 will be described as having an upper surface 14 and a lower surface 16. Table member 12 also has an outer edge 18. A plurality of support legs 20 have their upper ends secured to the lower surface 16 by any conventional means. A plurality of horizontally disposed support segments 22 are positioned on the upper surface 14 of table member 12. As seen, the support segments 22 have a straight inner end 24, sides 26 and 28, and a curved outer end 30. As seen, the curved outer ends 30 of the support segments 22 are spaced inwardly from the outer edge 18 of table member 12 to define a ring-shaped tray support surface 32.

As seen, the inner ends 24 of the support segments 22 are spaced-apart. A square, flat support member 34 is positioned on the upper surface 14 of table member 12 to create a square-recess 36 extending therearound. A plurality of roller balls 38 are mounted on the upper surface of ring-shaped tray support surface 32.

The numeral 40 refers to a ring-shaped tray which is rotatably positioned on the tray support surface 32. Tray 40 includes a vertically disposed circular ring-shaped outer wall

42 having an upper end 44, a lower end 46, an inner surface 48 and an outer surface 50. Tray 40 includes a horizontally disposed circular or ring-shaped bottom wall 52 having an outer end 54 and an inner end 56. The outer end 54 of bottom wall 52 extends inwardly from the inner surface 48 of outer wall 42 above the lower end 46 thereof to define a ring-shaped lip 58 at the lower end 46 of outer wall 42. Tray 40 also includes a vertically disposed inner wall 60 which extends upwardly from the inner end 56 of bottom wall 52. Inner wall 40 will be described as having a lower end 62 on upper end 64, an inner surface 66 and an outer surface 68. Tray 40 further includes a plurality of radially spaced-apart partition walls 70 which extend upwardly from bottom wall 52 between the inner surface 48 of outer wall 42 and the inner surface 66 of inner wall 60 to define a plurality of compartments 72 having open upper ends with the compartments configured to receive and separate various items such as an Lego components, beads, etc.

Table 10 also includes a horizontally disposed and circular table top 74 having an upper side 76, a lower side 78, and an outer peripheral end 80. The lower side 78 of table top 74 has a square connector member 82 secured thereto which extends downwardly therefrom. Connector member 82 will be described as having shoulders 84, 86, 88 and 90. Table top 74 is configured to be placed upon the upper surface 14 of table member 12. When so placed, the shoulders 84, 86, 88 and 90 of connector member 82 will be received in the recess 36. When so placed, the lower ends of the shoulders 84, 86, 88 and 90 will rest upon the upper surface 14 of table member 18 thereby causing the table top 74 to be positioned above the support segments 22 and the square flat member 34 to provide a storage area 92 beneath table top 74. As seen, when table top 74 is positioned on the support segments 22, the outer end 80 of table top 74 will be positioned over the upper end 64 of inner wall 60.

The tray 40 is easily rotated with respect to the table top 74 so that the person or persons utilizing the table 10 to build Legos or to assemble craft items may simply rotate the tray 40 to permit the person to have access to different compartments 72.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. A work table for use in assembling articles containing many different components, comprising:

a horizontally disposed circular table member having an upper surface, a lower surface, and an outer end;

a plurality of table legs, having upper and lower ends;

said upper ends of said table legs being secured to said lower surface of said circular table member for supporting said circular table member above a supporting surface;

a non-rotatable and horizontally disposed circular support, having an upper surface and a lower surface, positioned on said upper surface of said circular table member so as to extend upwardly therefrom;

said circular support having a diameter which is less than the diameter of said circular table member to define a tray support portion on said upper surface of said circular table member outwardly of said circular support;

a non-rotatable circular table top positioned above said circular support;

said table top having a diameter approximately the same as the diameter of said circular support;

a rotatable and horizontally disposed and ring-shaped tray positioned on said tray support portion so as to be selectively rotatable with respect to said circular support and said table top; and said ring-shaped tray having a plurality of compartments formed therein configured to receive the separate components of the article to be assembled.

* * * * *